US006718908B1

(12) United States Patent
Bayer et al.

(10) Patent No.: US 6,718,908 B1
(45) Date of Patent: Apr. 13, 2004

(54) COATING MACHINE FOR UPGRADING SHEET MATERIAL

(75) Inventors: Harald Bayer, Rodgau (DE); Georg Herzan, Oberursel/Taunus (DE); Klemens Kemmerer, Selingenstadt (DE)

(73) Assignee: MAN Roland Druckmaschinen AG, Offenbach/Main (DE)

( * ) Notice: Subject to any disclaimer, the term of this patent is extended or adjusted under 35 U.S.C. 154(b) by 0 days.

(21) Appl. No.: 09/807,281

(22) PCT Filed: Sep. 28, 1999

(86) PCT No.: PCT/EP99/07192

§ 371 (c)(1),
(2), (4) Date: May 14, 2001

(87) PCT Pub. No.: WO00/21683

PCT Pub. Date: Apr. 20, 2000

(30) Foreign Application Priority Data

Oct. 10, 1998 (DE) ..... 298 18 148 U

(51) Int. Cl.[7] ..... B05C 1/02

(52) U.S. Cl. ..... 118/46; 118/223; 118/236; 118/249; 118/261; 118/262; 101/229; 101/230; 101/416.1

(58) Field of Search ..... 118/46, 223, 236, 118/249, 261, 262; 101/229, 230, 416.1, DIG. 49; 427/208, 209, 211, 428

(56) References Cited

U.S. PATENT DOCUMENTS

| | | | | | |
|---|---|---|---|---|---|
| 4,188,883 | A | * | 2/1980 | Schone et al. | 101/183 |
| 4,664,949 | A | * | 5/1987 | Greiner et al. | 427/210 |
| 4,821,672 | A | * | 4/1989 | Bruno | 118/261 |
| 5,638,752 | A | * | 6/1997 | Hartung et al. | 101/177 |
| 5,651,316 | A | * | 7/1997 | DeMoore et al. | 101/450.1 |
| 5,960,713 | A | * | 10/1999 | DeMoore et al. | 101/137 |

FOREIGN PATENT DOCUMENTS

| | | |
|---|---|---|
| DE | 36 19 485 A1 | 12/1987 |
| DE | 42 13 024 A1 | 10/1993 |
| EP | 0 620 115 A1 | 3/1994 |

* cited by examiner

*Primary Examiner*—Laura Edwards
(74) *Attorney, Agent, or Firm*—Leydig Voit & Mayer

(57) ABSTRACT

A coating machine for applying a flowable coating substance to a sheet material to improve its surface. The coating machine has a series construction which lends itself to easy modification and versatile use. The coating machine includes, in a sheet conveyance direction, a first coating unit for applying a flowable substance to a front side of the sheet material, a sheet turning unit for reversing the position of the sheet, a first coating unit for applying a flowable substance to a reverse side of the sheet material, and sheet delivery unit. The coating units may have similar or identical constructions with interchangeable dosing systems.

14 Claims, 2 Drawing Sheets

COATING MACHINE FOR UPGRADING SHEET MATERIAL

FIELD OF THE INVENTION

The invention relates to a coating machine for upgrading sheet material by applying a flowable substance thereon.

BACKGROUND OF THE INVENTION

DE 36 19 485 A1 discloses a coating machine which permits the recessed or full-surface coating of webs or sheets with lacquer. This coating mechanism essentially consists of a counter-roller functioning as a counter-pressure cylinder, an inking roller standing in contact with the counter-pressure cylinder and functioning as a form cylinder, as well as a coating roller associated with the form cylinder which functions as an inking roller, and an associated dosing roller.

The coating roller and dosing roller in this machine form a dosing system (two-roller mechanism) with a roller gap in common. The entry of the flowable substance, in this case a lacquer, occurs by means of a feed device feeding lacquer into this roller gap. In the printing gap formed from the counter-pressure cylinder and the form cylinder there occurs the full-surface or the recessed coating of the print material by the lacquer.

A disadvantage with the above arrangement is that the flowable substance is applicable to the print material only on one side, and that in the recessed coating a distribution roller must additionally be allocated to the application roller.

OBJECTS AND SUMMARY OF THE INVENTION

It is an object of the present invention to provide an improved coating machine which avoids the foregoing disadvantages and which has particularly usage in sheet-fed rotary printing presses.

Another object is to provide a coating machine that can be operated in line for one-side (front side) or two-sides (front and back side) coating of sheet material. Moreover, during such in line operation, a multiple coating may be applied on one side or both sides of the sheet material.

A further object is to provide a coating machine that is adapted to improve the quality of printed sheet material, or even unprinted sheet material such as, for example, recycling material.

Yet another object is to provide a modular constructed coating machine that can be assembled in series. In this regard, simple assembly is achievable by a coating machine that has, in the conveyance direction of sheet material, a feeder unit, at least one first coating unit for the front side of the sheet material, a turning unit for the sheet material, at least one first coating unit for the reverse side of the sheet material, and a delivery unit. As a further aspect of the invention, second and third coating units for the front side as well as, for example second and third coating units for the reverse side of the sheet material are possible. All the coating units, furthermore, may have the same construction. Only the printing forms and the dosing system need be provided in correspondence to the coating requirement.

Between the coating units for the front side and also for the reverse side of the sheet material, there is arranged in each case at least one transfer drum for the sheet transport, the sheet-turning unit also taking over the function of the transfer drum.

As a further feature of the invention, the sheet turning unit of a series constructed coating machine can be switched over in its manner of operation. Accordingly, the coating machine with its coating units is usable for the one-side as well as two-side coating of the sheet material.

As a further feature of the invention at least one coating unit for the front side of the sheet material and at least one coating unit for the reverse side of the sheet material, in each case having a counter-pressure cylinder and a form cylinder, further having exchangeable coating metering or dosing systems for the processing of the flowable substances. Preferably, all the coating units have exchangeable dosing systems. In that case, the metering or dosing systems are usable in several-coating units with different and/or the same construction.

More particularly, each metering or dosing system preferably has an application roller standing in contact with the form cylinder. The application roller in the particular dosing system is, at will:

- a dosing roller assigned to the formation of a common roller gap, in which the flowable substance is feedable into this roller gap, or
- a wiper arranged with a circulation system having a feed line and lead-off line for the flowable substance, and in which the application roller is screen-gridded, or
- a scoop roller arranged in a supply container.

The form cylinder can optionally carry a flexible planographic printing form, for example a rubber blanket, or a flexible raised printing plate, for example a flexo print plate. Also UV-resistant flexo-print plates are usable.

Other objects and advantages of the invention will become apparent upon reading the following detailed description and upon reference to the drawings, in which:

Figure 1:
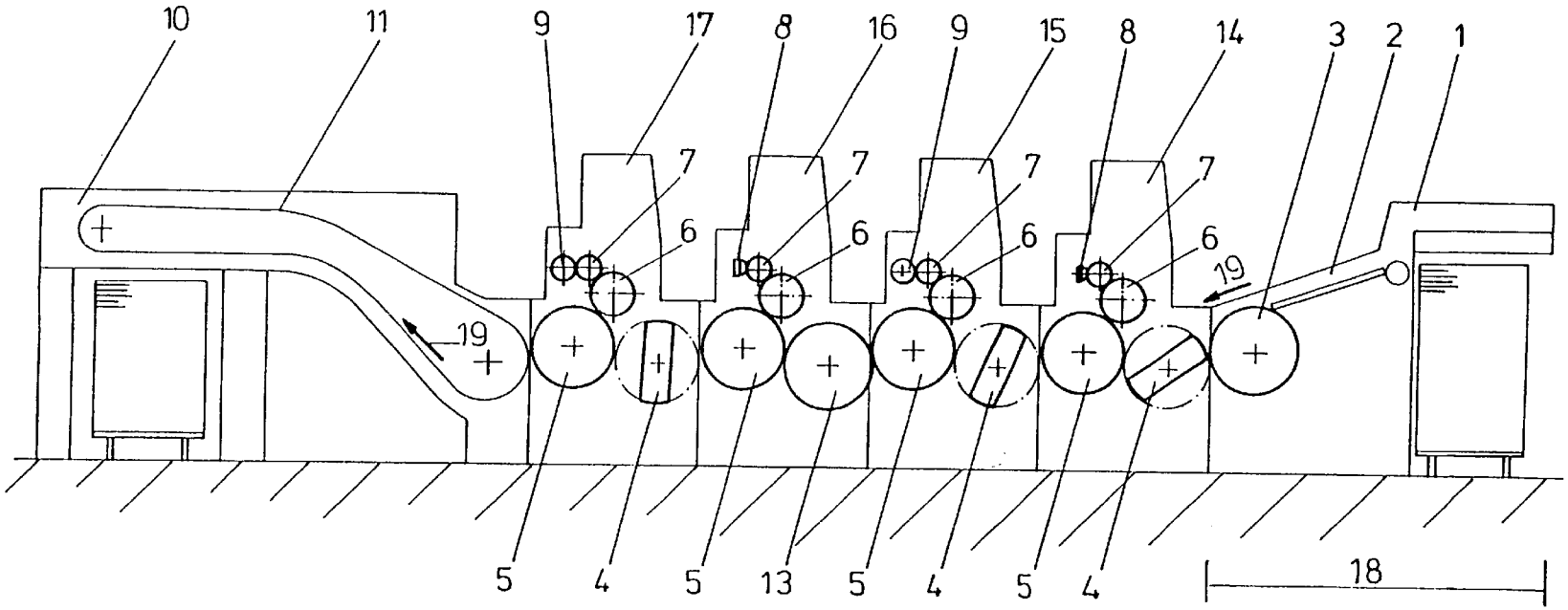
FIG. 1 is a side elevational view of a series constructed coating machine embodying the present invention.

While the invention is susceptible of various modifications and alternative constructions, certain illustrated embodiments thereof have been shown in the drawings and will be described below in detail. It should be understood, however, that there is no intention to limit the invention to the specific forms disclosed, but on the contrary, the intention is to cover all modifications, alternative constructions and equivalents falling within the spirit and scope of the invention.

DESCRIPTION OF PREFERRED EMBODIMENTS

Referring now more particularly to FIG. 1 of the drawings, there is shown an illustrative coating machine embodying the present invention. The coating machine, in the conveying direction has, in conveyance direction 19 of the sheet material, a feeder unit 18 which is formed by a feeder 1, a feed table 2, as well as a contact drum 3. The feeder unit 18 is followed by a first coating unit 14 for the sheet front side, as well as by a second coating unit 15 for the sheet front side. Between feeder unit 18 and the first coating unit 14, as well as between the first and the second coating units 14, 15, there is arranged in each case a transfer drum 4 for the sheet transport. After a second coating unit 15 for the sheet front side, there is arranged a sheet turning unit 13. After the sheet turning unit 13 there follows a first coating unit 16 for the sheet reverse side, after this a transfer drum 4, as well as a second coating unit 17 for the sheet back side. After the second coating unit 17 for the sheet back side, there is arranged a delivery unit 10 with revolving conveyance systems 11 for the purpose of feeding and depositing the sheet material onto a delivery stack.

Each of the coating units 14, 15 for the sheet front side, as well as units 16, 17 for the sheet reverse side, consists, in like construction, of a counter-pressure cylinder 5, a form cylinder 6 and an application roller 7 as part of the dozing system. Preferably, with respect to a single-size form cylinder 6, the counter-pressure cylinder 5 as well as the transfer drum 4 or a turning drum of the sheet turning unit 13, are constructed doubleized in each coating unit 14–17.

In the first coating unit 14 for the sheet front side, as well as in the first coating unit 16 for the sheet backside, the dosing system is formed in each case from a grid-patterned application roller 7, preferably a laser-engraved ceramic roller, and of a chamber wiper 8 with a conduction-side circulating system for the flowable substance to be processed. The form cylinders 6 for the first coating unit 14 for the sheet front side and first coating unit 16 for the sheet reverse side each carry a flexible raised-print form, for example a flexo print plate.

In the second coating unit 15 for the sheet front side, as well as the second coating unit 17 for the sheet reverse side the dosing system is formed in each case by the application roller 7 associated with the form cylinder 6 as well as a dosing roller 9. Application roller 7 and dosing roller 9 form a roller gap into which the flowable substance is directly fed from above. The form cylinder 6 of the second coating units, i.e., 15 for the sheet front side and 17 for the sheet reverse side, carry in each case a rubber blanker.

The operation of the coating machine illustrated in FIG. 1 is as follows. The sheet material is fed in conveyance direction 19 by means of feeder unit 18 and transfer drum 4 to the first coating unit 14 for the sheet front side. In the contact gap, formed by form cylinder 6 (with flexible raised-print form) and the sheet-conducting counter-pressure cylinder 5, there occurs a spot lacquering (recessed lacquering) onto the front side of the sheet material. In the contact gap of the following second coating unit 15 for the sheet front side, formed by form cylinder 6 (with rubber blanket) and the sheet-conducting counter-pressure cylinder 5 there occurs a full-surface lacquering. In both coating units 14, 15 aqueous dispersion lacquers preferably are used as flowable substances.

The sheet is turned over in the sheet turning unit 13 which operates according to the known principle of rear edge turning, in which the rear edge of the sheet material resting on a sheeL-conducting cylinder (counter-pressure cylinder 5) is grasped by sheet takeover systems, for example suction systems and gripper systems of the subordinate sheet turning unit 13 and then further transported in conveyance direction 19. It will be understood that operation of the sheet turning unit 13 can be switched over, so that so that it carries out the function of the transfer drum 4 in one-sided coating. The sheet turning unit 13 is preferably constructed as a single-drum turning, or as a multiple-drum turning unit with at least one storage drum arranged in front of the turning drum. Following the sheet turning unit 13 is the first coating unit 16 for the sheet reverse side. In its contact gap, formed by form cylinder 6 (with flexible raised print form) and the sheet-conducting counter-pressure cylinder 5, there occurs spot lacquering (recessed lacquering) on the back side of the sheet material. In the contact gap of the following second coating unit 17 of the reverse side, formed by the form cylinder 6 (with rubber blanket) and by the sheet-conducting counter-pressure cylinder 5, there occurs a full-surface lacquering.

In both coating units 16, 17 aqueous dispersion lacquers preferably are used as flowable substances. After the evaporation of the water in the dispersion lacquer, a resistant, closed coating exits on the sheet surface.

While the illustrated coating machine is operable for two-sided coating (front/reverse sides) of sheet material, alternatively the machine can be operated for one sided-coating of the sheet material. For this, depending on the side of the sheet material to be printed, the first and second coating units 14, 15 for the sheet front side is activated if the front side of the print material is to be coated. The sheet-turning unit 13 then operates and functions as transfer drum 4 (without sheet turning) and the subsequent coating units 16, 17 for the sheet reverse side are inactive; i.e. they do not participate in the coating operation, nor undertake further coatings on one side of the sheet material.

If the back side of the sheet material is to be coated on one side, then the first and second coating units 14, 15 for the sheet front side 15, 16 are inactive (not participating in the coating operation). The sheet-conducting cylinders (i.e., counter-pressure cylinder 5, transfer drum 4) conduct the sheet material to the sheet turning unit 13. The sheet turning unit 13 turns the sheet material and the subsequent first and second coating units 16, 17 for the sheet reverse side are activated and carry out the corresponding coatings.

Figure 2:
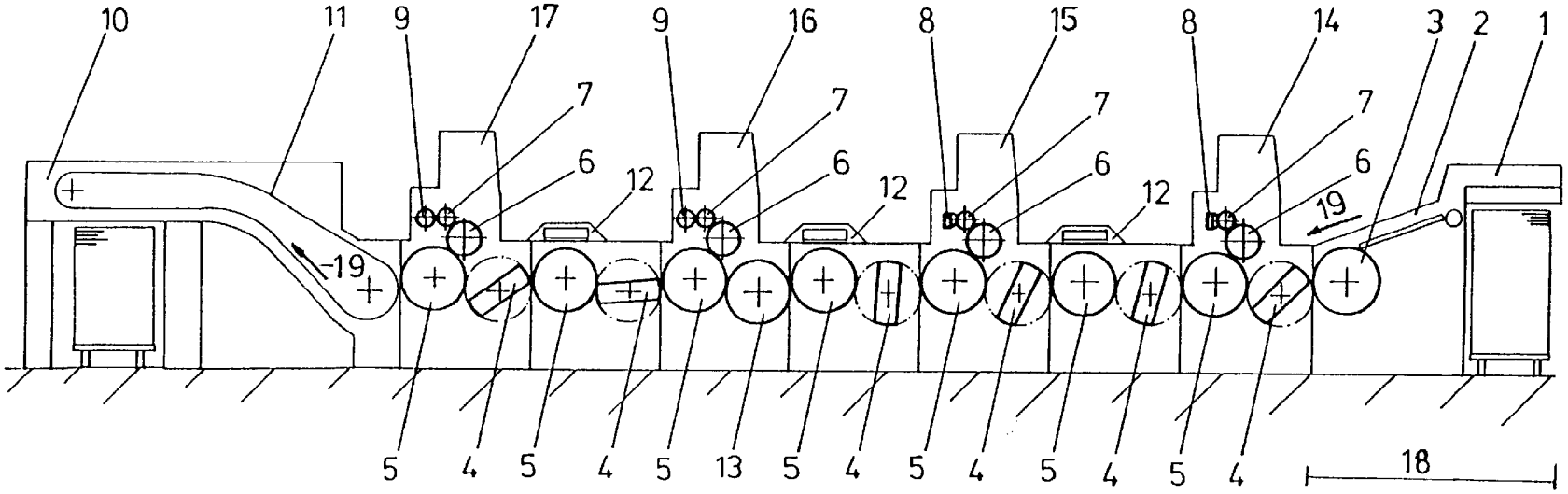
FIG. 2 is a side elevational view of an alternative embodiment of coating machine.

An alternative embodiment of coating machine is illustrated in FIG. 2, wherein the first coating unit 14 for the sheet front side is constructed and operates similar to the first coating unit 14 in the previously disclosed embodiment of FIG. 1. In the second coating unit 15 for the sheet front side, the contact roller 7 (from FIG. 1) is exchanged for a contact roller 8 with a grid-patterned structure (FIG. 2), and the dosing roller 9 (from FIG. 1) is exchanged for a chamber wiper 8 (FIG. 2). In the first coating unit 16 for the sheet reverse side, the patterned application (contact) roller 7 (FIG. 1) is exchanged for an application roller (FIG. 2) with lower surface hardness than the patterned application roller. The chamber wiper (FIG. 1) is exchanged for a dosing roller 9 with higher surface hardness than the application roller 7. The dosing roller 9 as well as the application (contact) roller 7 are preferably exchangeable among one another in their bearing locations in all of the coating units 14–17.

The dosing system formed from patterned application (contact) roller 7 and the chamber wiper 8 is suited in this construction for the improving of the sheet material with dispersion lacquer, or UV-lacquer, or flexo-printing paint. In the processing of dispersion lacquer the form cylinder 6 carries a rubber blanket or, in the processing of dispersion lacquer for flexo-print paint, it carries a flexible raised-print plate. In the processing of UV-lacquer, a UV-resistant flexible raised-print plate is arranged on the form cylinder 6.

Between the first coating unit 14 for the sheet front side and the second coating unit 15 for the sheet front side there is formed a first dryer module, which includes a transfer drum 4 and a counter-pressure cylinder 5, as well as a dryer system 12 associated with to the counter-pressure cylinder 5. In conveyance direction 19 following the second coating unit 15 for the sheet front side) a second dryer module, formed from transfer drum 4, counter-pressure cylinder 5 as well as a further dryer system 12. After the second dryer module there follows a sheet turning unit 13 as well as the first coating unit 16 for the sheet reverse side. Upon this coating unit 16 for the sheet reverse side there follows, in like construction, a third dryer module, following which is the second coating unit 17 for the sheet reverse side.

The patterned application (contact) roller 7 as well as the chamber wiper 8 (according to FIG. 1) are exchanged for an application roller 7 and a dosing roller 9. The form cylinder 6 carries a rubber blanket for full-surface or for recessed lacquering.

According to an extremely simple embodiment, the coating machine can be constructed in the conveyance direction 19 with the feeder unit 18, only one first coating unit 14 for the sheet front side, a sheet turning unit 13, only the first coating unit 16 for the sheet reverse side, and an ultimate delivery unit 10, the coating elements 14, 16 being of like construction.

A series constructed coating machine may be simply achieved, in the conveying direction 19 by the feeder unit 18, at least the first coating unit 14 for the sheet front side followed by the sheet turning unit 13, the first coating unit 16 for the sheet reverse side, and the delivery unit 10.

Optionally, there can additionally be arranged further coating units 14–17 for the sheet front side/and/or the sheet reverse side, as shown for example, in FIGS. 1 and 2.

A further construction may be characterized by the first coating unit 14 for the sheet front side having as dosing system with an application roller 7 and a dosing roller 9 with common roller gap and a feed unit supplying the flowable substance from above. The form cylinder 6 in this case carries a rubber blanket, so that a full-surface coating of the sheet material is achieved. The second coating unit 15 for the sheet front side has a patterned application roller with an associated chamber wiper 8. In this instance, the form cylinder 6 carries a flexible raised-print plate so that a recessed coating (spot coating) is achievable. By means of this spot coating a "floating" coating is achieved on the previously applied full-surface one-side coating (in this case on the sheet front side.).

The foregoing working principle is suited, for example, for the embedding of certain effects into the already performed full-surface coating or for the improvement of the lustre. In a further development, this working principle is applicable in the first and second coating units 16, 17 for the sheet reverse side, in which case the sheet turning unit 13 for the sheet material first is passed. In this instance, the first coating unit 16 for the sheet reverse side is constructed similarly to the above-described first coating unit 14 for the front side, and the second coating unit 17 for the sheet back side is constructed similarly to the above-described second coating unit 15 for the sheet front side. Since the dosing systems are exchangeable among one another, after a brief refitting a construction of the coating machine again is achievable, for example, according to FIG. 1.

A further embodiment is achievable when the first coating unit 14 for the front side has a dosing system that includes a patterned application roller 7 with allocated chamber wiper 8. The form cylinder 6 carries a flexible raised-print form. The second coating unit 15 for the sheet front side has a dosing system that includes an application (contact) roller 7 and a dosing roller 9 with a common roller gap, in which the form cylinder 6 carries a rubber blanket. Following the second coating unit 15 for the sheet front side, there may be a third coating unit for the sheet front side (not shown). This coating unit has a counter-pressure cylinder 6 as well as a patterned application (contact) roller 7 with an allocated chamber wiper 8. In this construction, in the first coating unit 14 there occurs a spot coating, in the second coating unit 15 a full-surface coating, and in the third coating unit a renewed spot lacquering for the "floating" coating, for example, in effect lacquering into the full-surface coating. This working principle is likewise applicable for the first and second coating units 16, 17 for the sheet reverse side (not shown). The first and second coating units 16, 17 as well as the third coating unit for the sheet reverse side are constructed similarly to the first and second coating units 14, 15 as well as the third coating unit for the sheet front side.

Depending on the flowable substance to be processed, dryer modules may be provided in the above-mentioned embodiments of the coating machine, especially between the coating units 14–17. Each dryer module includes a transfer drum 4 and an after-engaged counter-pressure cylinder 5 with an associated dryer system 12. The elements for the sheet conduction, as well as the requisite washing devices, for example, for the form cylinder, will be understood by a person skilled in the art and will not be described in detail.

It will be understood herein that each form cylinder 6 can optionally carry different printing forms, for example a flexible flat print form or a flexible raised print form, as the coating form. The dosing systems need not be restricted to a patterned application (contact) roller 7 with chamber wiper 8 or application roller 8, and dosing roller 9. On the contrary, alternative dosing systems can be used. For example, a substance scooping roller plunging into a container of the flowable material and an associated dosing application roller, may be used as dosing system, in which the application roller is allocated to the form cylinder 6. To this scooping roller mechanism there can additionally be allocated a dosing roller. Independently from the particular coating units 14–17, the dosing systems are interchangeable among one another. The number of coating units 14, 15 in front of the sheet-turning unit 13 also can be set equal to the coating units 16, 17, or unequal thereto.

What is claimed is:

1. A coating machine for applying coatings to sheet material as it is moved in a sheet conveyance direction for improving the sheet surface quality comprising in the sheet conveyance direction a feeder for feeding sheet material, at least one coating unit for applying a flowable coating substance to a front side of the sheet material, a sheet turning unit for reversing the position of the sheet, at least one coating unit for applying a flowable coating substance to a reverse side of the sheet material, a delivery unit for receiving and delivering the coated sheet material, sheet transfer drums (4) for transferring sheets between said coating units said coating units being of like construction each including a form cylinder, a counter pressure cylinder, and a metering system having an application roller associated with the form cylinder, said form cylinder for each coating unit carrying a flexible printing form for receiving a flowable coating substance from the metering system for transfer to passing sheet material, and the flexible printing form for each said coating unit form cylinder being one of a flexible planographic printing form or a flexible raised printing plate.

2. The coating machine of claim 1 including a further coating unit for the sheet reverse side located in the sheet conveyance direction after the second coating unit for the sheet reverse side.

3. The coating machine of claim 1 in which sheet turning unit includes at least one turning drum.

4. The coating machine of claim 1 in which each metering system application roller has an associated dosing roller for forming a roller gap therebetween.

5. The coating machine of claim 4 in which each metering system application roller has a grid pattern and an associated chamber wiper roller that communicates with a circulation system for the flowable substance.

6. The coating machine of claim 4 in which each metering system application roller has a scooping roller associated therewith disposed within a container for the flowable substance.

7. The coating machine of claim 1 in which each coating unit has a metering system that is interchangeable with the metering system of another of the coating units.

8. The coating machine of claim 1 including a second coating unit for the sheet front side located in a sheet conveyance direction between the at least one coating unit for the sheet front side and said sheet turning unit, a second coating unit for the sheet reverse side located in a conveyance direction after the at least one coating unit for the sheet reverse side, and dryer modules located between the coating units for the sheet front side and the coating units for the sheet reverse side.

9. The coating machine of claim 8 in which each said dryer module includes a transfer drum, a counter pressure cylinder associated with the transfer drum, and an associated dryer system.

10. The coating machine of claim 1 in which said coating units are operable for applying a coating in the form of a lacquer to the sheet material.

11. The coating machine of claim 1 in which said flexible printing forms for each said form cylinder include one of a rubber blanket for full surface coating surfaced blanket or a flexo-print plate spot coating of the sheet material.

12. The coating machine of claim 1 in which the flexible printing form for at least one of said coating unit form cylinders is a flexible planographic printing form full surface coating and the flexible printing form for another of said coating units is a flexible raised printing plate for spot coating of the sheet material.

13. The coating machine of claim 1 including a second said coating unit for applying a flowable coating substance to a front side of said sheet material, and a second coating unit for applying for a flowable coating substance to a reverse side of the sheet material.

14. A coating machine for applying coatings to sheet material as it is moved in a sheet conveyance direction for improving the sheet surface quality comprising in the sheet conveyance direction a first coating unit for applying a flowable coating substance to a front side of the sheet material; a second coating unit for applying a flowable coating substance to a front side of the sheet material; a sheet turning unit for reversing the position of the sheet, a first coating unit for applying a flowable coating substance to a reverse side of the sheet material; a second coating unit for applying a flowable coating substance to a reverse side of the sheet material; a delivery unit for receiving and delivering the coated sheet material; and said coating units each including a printing form carrying form cylinder, a counter pressure cylinder, and a dosing system having an application roller associated with the form cylinder; and one of said coating units for the sheet front side and one of the coating units for the sheet reverse side being operable for applying a patterned coating to the sheet material and one of said coating units for said first side and one of said coating units for said reverse side being operable for applying a full surface coating to the sheet material.

* * * * *